United States Patent [19]

Greenberg

[11] Patent Number: 4,615,167

[45] Date of Patent: Oct. 7, 1986

[54] HIGHLY ENTANGLED THREAD DEVELOPMENT

[76] Inventor: Neville G. Greenberg, 2995 Courtland Dr., Gastonia, N.C. 28054

[21] Appl. No.: 747,789

[22] Filed: Jun. 25, 1985

Related U.S. Application Data

[63] Continuation-in-part of Ser. No. 688,739, Jan. 4, 1985, abandoned, which is a continuation-in-part of Ser. No. 664,780, Oct. 25, 1984, abandoned.

[51] Int. Cl.[4] ..... D02G 1/16; D02G 1/18; D02G 3/34; D02G 3/36

[52] U.S. Cl. ..... 57/6; 28/220; 28/254; 28/273; 57/207; 57/208; 57/295; 57/309; 57/7; 57/310; 57/350

[58] Field of Search ..... 57/6, 210, 7, 295, 309, 57/350, 207, 208, 310; 28/271–276, 220, 252, 254

[56] References Cited

U.S. PATENT DOCUMENTS 4,280,261 7/1981 Nelson ..... 57/6 X
4,319,447 3/1982 Barron ..... 57/6
4,343,146 8/1982 Nelson ..... 57/350 X
4,497,099 2/1985 Scott ..... 57/6 X

*Primary Examiner*—John Petrakes
*Attorney, Agent, or Firm*—Cushman, Darby & Cushman

[57] ABSTRACT

A method and apparatus for forming a yarn or sewing thread from core and effect yarns. The effect yarn is drawn at no higher than a normal drawing ratio for material from which the effect yarn is made and the effect yarn is softened by sufficient heating, in order to prevent rupturing of the effect yarn during drawing. The core or effect yarn is passed through a wetting device to aid aspiration and entanglement of the core and effect yarns in a fluid jet device. The effect yarn is overfed to the jet device to aid in the formation of a highly entangled looped yarn which is subsequently set by a heated roller while contraction of the yarn is prevented. The core yarn can also be drawn at or below its normal drawing ratio in order to aid in developing thread tenacity and ensure an acceptable elongation at break after dyeing or subsequent wet processing.

36 Claims, 7 Drawing Figures

FIG. 5
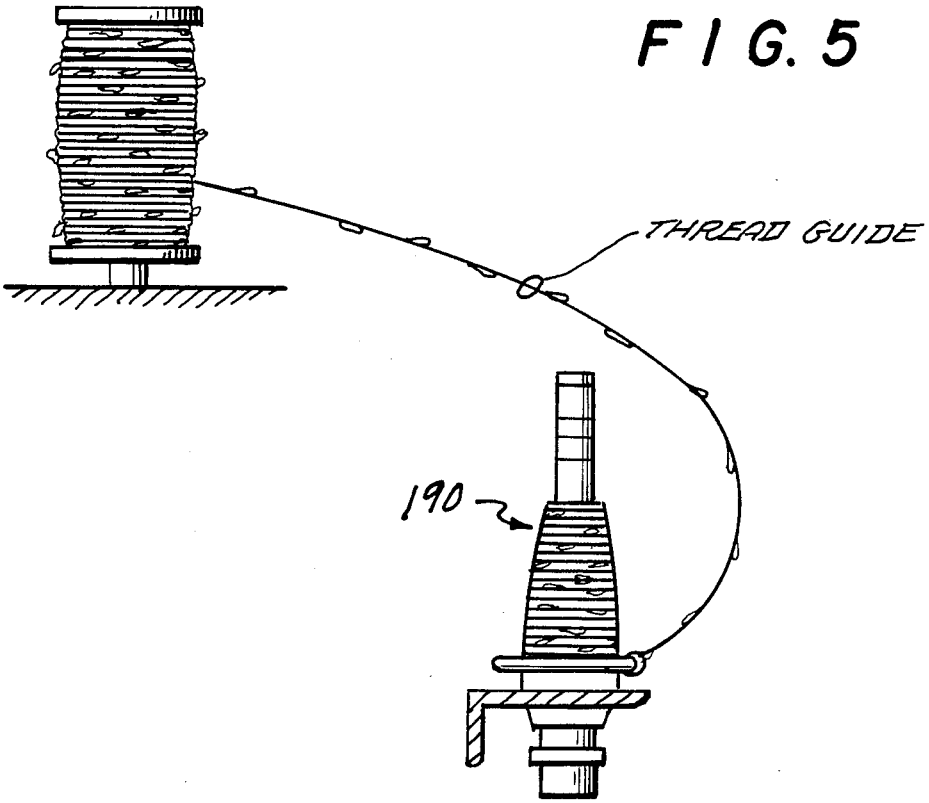
FIG. 6
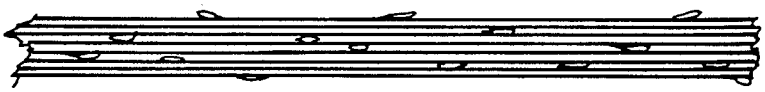
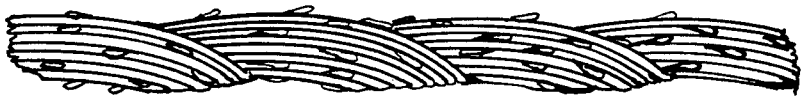
FIG. 7

HIGHLY ENTANGLED THREAD DEVELOPMENT

This is a continuation-in-part (CIP) of application Ser. No. 688,739, filed Jan. 4, 1985, now abandoned, which is a continuation-in-part (CIP) of application Ser. No. 664,780, filed Oct. 25, 1984, now abandoned.

FIELD OF THE INVENTION

The invention is directed to a method and apparatus for fluid jet texturing of multifilament yarns. The invention is specifically applicable for using fluid jet texturing to produce sewing thread according to the "core and effect" method.

BACKGROUND OF THE INVENTION

The techniques of fluid or air jet texturing to produce highly entangled multifilament yarns or sewing thread is gaining prominence. The finished product falls into two principal categories. First, a relatively low level of thread entanglement usually supplemented by twisting to improve sewing performance. And second, a high level of thread entanglement utilizing the "core and effect" principal to optimize tenacity and modulus. The latter of these two categories generally provides thread or yarn having a better overall performance as compared to the first category.

United Kingdom Patent Application No. 2,092,189A to Scott, corresponding to U.S. Pat. No. 4,497,099, hereinafter referred to as Scott, proposes to induce a high level of shrinkage in one or more components comprising the effect yarn by drawing the components more than normal. This high level of shrinkage is used to reduce the size of the effect yarn loops in order to create locked in buds around a central core yarn component while passing the whole yarn around a heated roll and holding the yarn to a predetermined length. Thus, Scott produces a yarn in which there is a complete absence of loops on the surface of the finished product and in which the finished product is completely stable in that it will not experience shrinkage.

However, the Scott method has a distinct disadvantage. Namely, when drawing the effect yarn at a drawing ratio higher than normal, it is possible to rupture the filaments of the yarn thereby affecting the production and the quality of the finished product.

SUMMARY OF THE INVENTION

The invention provides methods and apparatuses for producing a highly entangled yarn which is not subject to the above described disadvantages of Scott. The methods of the invention exhibit the following features: (a) the effect yarn is drawn at or below the normal drawing ratio which reduces the possibility of inconsistent dyeing and controlled shrinkage of the loops is obtained by heating the yarn during drawing sufficiently to soften the yarn without rupturing any filaments; (b) the core or effect yarn is wetted to aid aspiration and entanglement of the core and effect yarns in the fluid jet; and (c) the set yarn obtained by passing a highly entangled looped yarn around a heated roller maintains loops on the set yarn surface. Accordingly, the present invention is advantageous in that it produces a yarn or sewing thread in which the possibility of rupture of the effect yarn is greatly reduced, since the effect yarn is drawn at or below the normal drawing ratio. The methods of the invention are further advantageous in that aspiration and entanglement in the fluid jet are greatly enhanced by wetting the core or effect yarn. This feature results in a better quality finished product in addition to increasing the yield and the efficiency of the methods. Furthermore, subsequent twisting of the air entangled product improves sewing performance.

The first method comprises the following steps. First, drawing an effect yarn, which comprises one or more multifilament yarns, at a normal drawing ratio for material from which the effect yarn is made. Second, passing the core or effect yarn, each of which comprises one or more multifilament yarns, through a wetting device. Third, overfeeding the effect yarn to a fluid jet. Fourth, feeding the core yarn to the fluid jet. Fifth, forming a highly entangled looped yarn from the core and effect yarns in the fluid jet, the effect yarn having loops on its surface. Sixth, passing the highly entangled loop yarn around a heated roller while preventing the core yarn from contracting. Seventh, annealing and shrinking the surface loops of the effect yarn around the core yarn in order to form a set yarn. And, finally, winding the set yarn onto a holder for subsequent processing, while preventing the set yarn from contracting.

The second method includes the following steps. First, drawing an effect yarn, which comprises two or more multifilament yarns, at a normal drawing ratio for the material from which the yarn is made. Second passing the core or effect yarn, each of which comprises one or more multifilament yarns, through a wetting device. Third, inducing differential shrinkage characteristics in the multifilament yarns, which comprise the effect yarn, by differential draw temperatures provided by hot pins. Fourth, overfeeding the multifilament yarns, which comprise the effect yarn, to a fluid jet. Fifth, feeding the core yarn to the fluid jet. Sixth, forming a highly entangled looped yarn from the core and effect yarns in the fluid jet, the effect yarn having surface loops. Seventh, passing the highly entangled looped yarn around a heated roller for causing the overfed yarn having the highest shrinkage characteristic to lock the loops of the other yarns to form a set yarn, in which loops are maintained. And finally, winding the set yarn onto a holder for subsequent processing, while preventing the set yarn from contracting.

The third and fourth methods, respectively, modify the first and second methods by requiring that the core yarn is also drawn at or below its normal drawing ratio. Drawing both the core and effect yarns at or below their respective normal drawing ratios aids in developing thread tenacity and ensures an acceptable elongation at break after dyeing or subsequent wet processing.

As noted above, subsequent twisting of the finished product further improves sewing performance. Accordingly, each one of the four methods described above may include a subsequent twisting step.

The apparatus of the invention comprises at least one drawing stage and hot pin for drawing the effect yarn and may also include a second drawing stage including a hot pin for drawing the core yarn, when the core yarn is comprised of partially oriented yarn (POY). Of course, the second drawing stage would not be necessary when already drawn core yarn is used. The apparatus for practicing the second and fourth methods also includes hot pins in the drawing stage used to draw the effect yarn in order to induce the differential shrinkage characteristics. A fluid jet, which typically comprises a conventional air jet, is used to receive the core and effect yarns and to produce a highly entangled looped yarn. The apparatus further comprises a heated roller assembly for receiving the high entangled looped yarn from the air jet and for outputting a set yarn while preventing the set yarn from contracting.

When the finished product is to undergo subsequent twisting the apparatus further includes a conventional twister bobbin such as those manufactured by A. B. Carter Inc.

BRIEF DESCRIPTION OF THE DRAWINGS

FIG. 5 shows a twister bobbin for twisting the finished product.

FIGS. 6 and 7 show untwisted and twisted finished products, respectively.

DETAILED DESCRIPTION OF THE INVENTION

Figure 1:
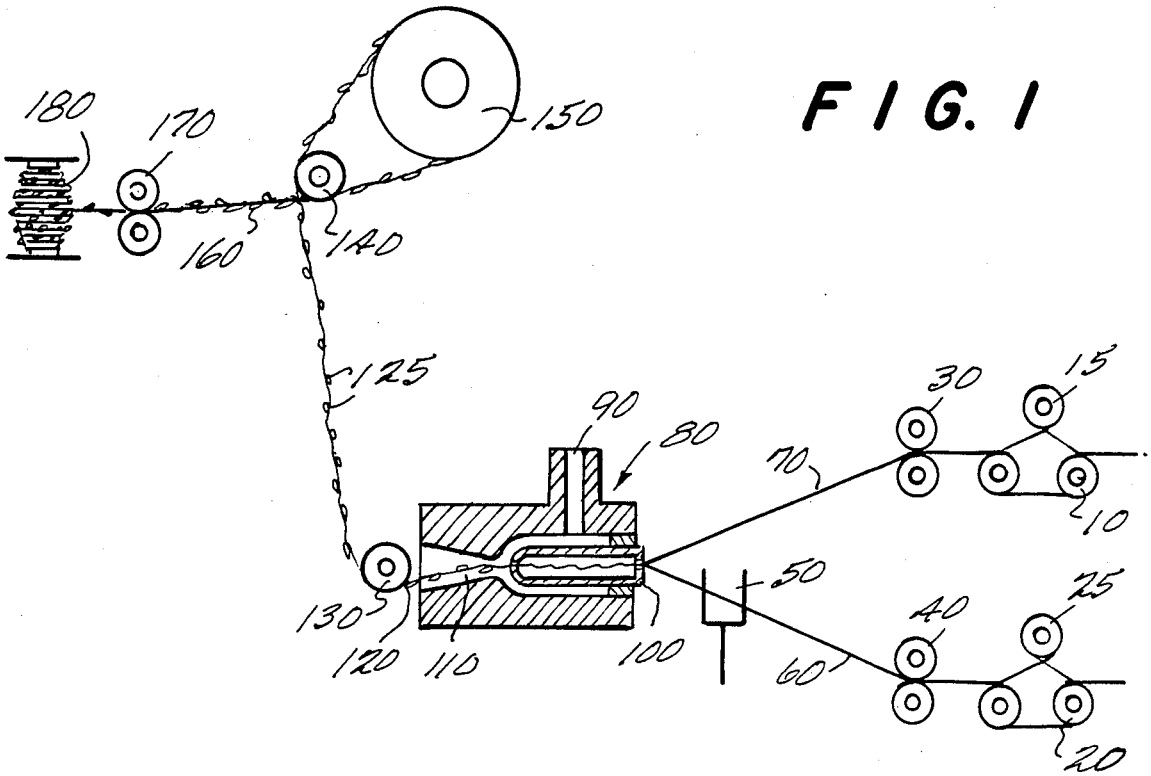
FIG. 1 shows an apparatus for practicing a first process according to the invention.
Figure 2:
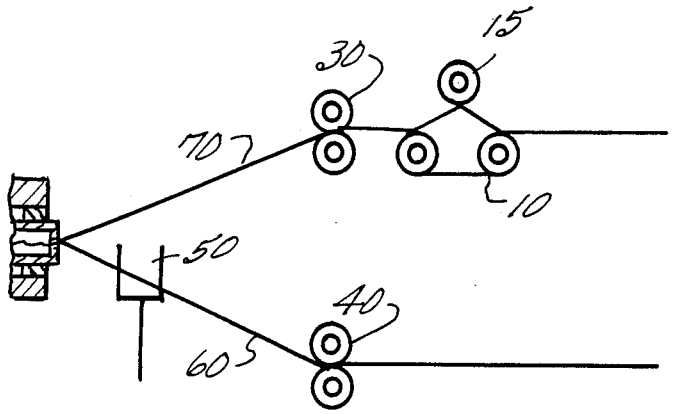
FIG. 2 shows a modification of the FIG. 1 apparatus.

FIG. 1 shows an apparatus for practicing the first and third methods of the invention for producing an air entangled sewing thread. The apparatus comprises first drawing rollers 10 and hot pin 15 and feed rollers 30 for feeding an effect yarn 70. A second set of drawing rollers 20 together with a hot pin 25 are provided when the core yarn 60 comprises POY, but can be omitted when a drawn core yarn 60 is used, as shown in FIG. 2. The core yarn 60 or effect yarn 70 is fed by feeding rollers 30 or 40, respectively, through a wetting device 50 to the air or fluid jet device 80. The wetting device 50 is shown in all the Figures to wet the core yarn 60, however, this is for convenience only in that, as stated above, either the core or effect yarn can be wetted in the wetting device.

The core and effect yarns enter a movable passage device 100 within the jet device 80 with the effect yarn being overfed. The amount of overfeed can range from 25% to 75% and is determined by the end use of the finished product and the denier of the core yarn used, with a higher denier core yarn requiring a higher effect yarn overfeed. The core and effect yarns are caused to intermingle with each other in a mixing chamber 110 of the jet device 80, the air or fluid entering the ject device 80 at an opening 90. As will be readily appreciated by those of ordinary skill in the art, the position of the movable passage device 100 determines the degree of aspiration and entanglement of the yarns.

It should also be pointed out that passing the core or effect yarn through the wetting device 50 also significantly aids the aspiration and entanglement of the core and effect yarn. Furthermore, since the effect yarns are drawn substantially at or less than the normal drawing ratio for material from which the effect yarn is made, controlled shrinkage of the loops is obtained and the effect yarn is softened by heating the yarn during drawing, so that the likelihood of rupture of the effect yarn filaments is thus further reduced. The above described features also reduce the possibility of inconsistent dyeing. In addition, as noted above, when the core yarn is also drawn at or less than the normal drawing ratio for material from which it is made, the development of the thread's tenacity is aided and an acceptable elongation at break after dyeing or subsequent wet processing is ensured.

The highly entangled loop yarn 120 output from the jet device 80 is passed around a roller 130, which is adjustable in position, and passed to a separator roller 140. The highly entangled loop yarn 120 contains loops 125, as it passes from the separator roller 140 to a heated roller 150 which is preferably heated in excess of 125° C. As the highly entangled loop yarn 120 is passed around the heated roller 150 the yarn is set, in that the loops shrink and are annealed around the other yarns. Furthermore, the combination of the position adjustable roller 130, the separator roller 140, the heated roller 150 and a set of nip rollers 170 serve to maintain the intermingled yarn at a predetermined length as it is being set.

It should be noted that the set yarn 160 maintains loops on its surface, although these loops are somewhat reduced in size as compared to the loops 125 of the highly entangled loop yarn 120 output from the jet device 80. The set yarn 160 is provided from the nip rollers 170 to a winding device 180 onto which the set yarn is wound for subsequent processing.

Figure 3:
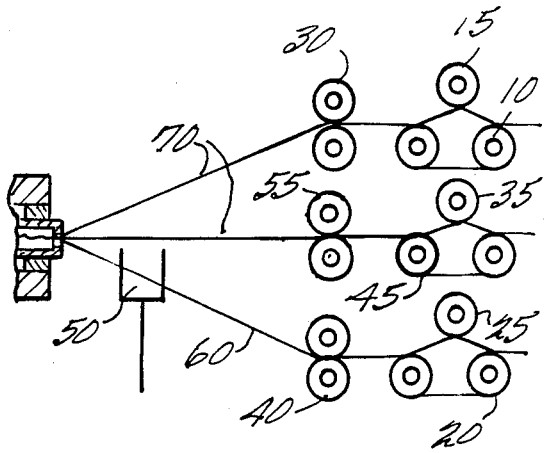
FIG. 3 shows a modification of the FIG. 1 apparatus for practicing a second process according to the invention.
Figure 4:
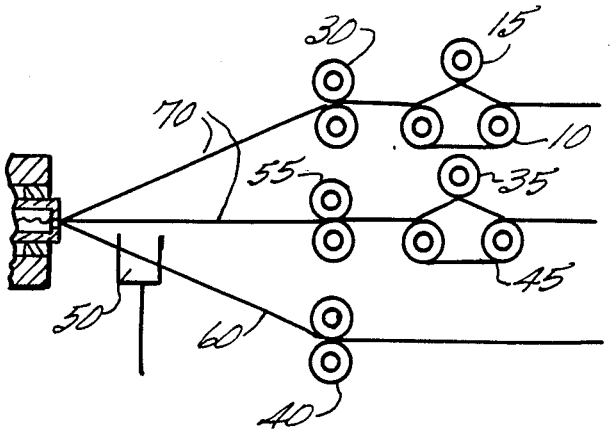
FIG. 4 shows a modification of the FIG. 3 apparatus.

FIG. 3 shows a modification of the apparatus shown in FIG. 1, the modified apparatus being used to practice the second and fourth methods of the invention. In FIG. 3, components which are identical to components shown in FIG. 1 have identical reference numbers and since these components operate in the same way a detailed description of their operation has been omitted. Thus, the modification of the aforementioned FIG. 1 apparatus comprises the inclusion of hot pins 15 and 35 which operate, respectively, in conjunction with the drawing rollers 10 and 45 for drawing the effect yarn. The hot pins 15 and 35 are used to induce differential shrinkage in a plurality of multifilament yarns making up the effect yarn by providing different draw temperatures. Another set of drawing rollers 20 together with a hot pin 25 are provided when the core yarn 60 comprises POY, but can be omitted when a drawn core yarn 60 is used, as shown in FIG. 4. In FIG. 3 there are shown two multifilament yarns comprising the effect yarn, but it should be understood that this is for convenience only and the invention can also comprise more than two differentially shrinkable multifilament yarns.

The yarns with differential shrinkage, which comprise the effect yarn, are overfed into the jet device 80. As stated above, the amount of overfeed can range from 25% to 75% and is determined by the end use of the finished product and the denier of the core yarn used, with a higher denier core yarn requiring a higher effect yarn overfeed. The core or effect yarn is passed through the wetting device to aid aspiration of the high overfeed. The effect and core yarns are entangled in the jet device in the same manner as has been described above with reference to FIG. 1. The highly entangled loop yarn output from the jet device is then passed around the heated roller, in a similar manner as has been described with respect to the first method described above, and the surface temperature of the heated roller is preferably in excess of 125° C.

During its passage around the heated roller, the yarn with the highest induced shrinkage characteristics locks the loops of the other yarns while the highly entangled looped yarn and the set yarn which results from passage around the heated roller is prevented from contracting by the combination of rollers, as described above with respect to the first method.

It should be pointed out that although the yarn with the highest shrinkage locks the loops of the other yarns as described above, not all of the surface loops are eliminated. The resulting set yarn is then wound on a winding device, similarly as has been described above with respect to the yarn produced by the first described method.

Accordingly, the above described methods result in superior quality sewing thread with the first method producing a more desirable quality thread as compared to the second method, the thread produced by the first method exhibiting a higher tenacity for medium to low denier yarns. Furthermore, the third and fourth methods provide additional advantages over the first and second methods, respectively, in that the development of the thread's tenacity is aided and an acceptable elongation at break after dyeing or wet processing is ensured.

FIG. 5 shows a conventional twister bobbin 190 and a thread guide for subsequent twisting of the sewing thread produced by any of the four methods described above. FIGS. 6 and 7 respectively illustrate the untwisted and the twisted sewing threads produced before and after the twisting step carried out in the twister bobbin 190.

It should be appreciated that the above described methods and apparatuses of the preferred embodiments do not limit the scope of the present invention in any way, and that various changes and modifications may be made without departing from the spirit and scope of the present invention.

What is claimed is:

1. A method of forming a yarn from a core yarn and an effect yarn, comprising the steps of:

drawing said effect yarn, comprising at least one multifilament yarn, at substantially no higher than a normal drawing ratio for material from which the effect yarn is made and heating said effect yarn sufficiently in order to soften the effect yarn, to prevent rupturing the effect yarn during drawing and to reduce the possibility of inconsistent dyeing in a subsequent process;

transporting any one of said core and effect yarns, through a wetting device;

overfeeding said effect yarn to a fluid jet the amount of overfeeding being dependent on the denier of the core yarn;

feeding said core yarn to said fluid jet;

forming a highly entangled looped yarn from said core and effect yarns in said fluid jet, wherein said effect yarn has surface loops;

passing said highly entangled looped yarn around a heated roller to form a set yarn, while preventing said highly entangled loop yarn from contracting and preserving said surface loops in said effect yarn; and winding said set yarn onto a holder while preventing the set yarn from contracting.

2. A method as claimed in claim 1 wherein the temperature of said heated roller used in said passing step is in excess of 125° C.

3. A method as claimed in claim 1, wherein the fluid jet used in said forming step is an air jet.

4. A method as claimed in claim 1, further comprising a core drawing step for drawing said core yarn when said core yarn comprises POY.

5. A method as claimed in claim 1, further comprising the step of twisting said set yarn.

6. A method of forming a yarn from a core yarn and an effect yarn, comprising the steps of:

drawing said effect yarn, comprising at least one multifilament yarn, at substantially no higher than a normal drawing ratio for material from which the effect yarn is made and heating said effect yarn sufficiently in order to soften the effect yarn, to prevent rupturing the effect yarn during drawing and to reduce the possibility of inconsistent dyeing in a subsequent process;

transporting any one of said core and effect yarns through a wetting device;

overfeeding said effect yarn to a fluid jet, the amount of overfeeding being dependent on the denier of the core yarn;

feeding said core yarn to said fluid jet;

forming a highly entangled looped yarn from said core and effect yarns in said fluid jet, wherein said effect yarn has surface loops;

passing said highly entangled looped yarn around a heated roller while preventing it from contracting;

annealing and shrinking said surface loops around said core yarn for forming a set yarn; and winding said set yarn onto a holder while preventing the set yarn from contracting.

7. A method as claimed in claim 6, wherein the temperature of said heated roller used in said passing step is in excess of 125° C.

8. A method as claimed in claim 6, wherein the fluid jet used in said forming step is an air jet.

9. A method as claimed in claim 6, further comprising a core drawing step for drawing said core yarn when said core yarn comprises POY.

10. A method as claimed in claim 6, further comprising the step of twisting said set yarn.

11. A method of forming a yarn from a core yarn and an effect yarn comprising the steps of:

drawing said effect yarn, comprising a plurality of multifilament yarns, at substantially no higher than a normal drawing ratio for material from which said effect yarn is made and heating said effect yarn sufficiently in order to soften the effect yarn, to prevent rupturing the effect yarn during drawing and to reduce the possibility of inconsistent dyeing in a subsequent process;

transportating any one of said core and effect yarns, through a wetting device;

inducing differential shrinkage in said plurality of multifilament yarns by differential draw temperatures provided by hot pins;

overfeeding said plurality of multifilament yarns with differential shrinkage comprising said effect yarn to a fluid jet the amount of overfeeding being dependent on the denier of the core yarn;

feeding said core yarn to said fluid jet;

forming a highly entangled looped yarn from said core and effect yarns in said fluid jet, wherein said effect yarn has surface loops;

passing said highly entangled looped yarn around a heated roller for causing the overfed yarn having the highest shrinkage to shrink and thus lock the loops of the other yarns thereby forming a set yarn, wherein said highly entangled looped yarn is prevented from contracting; and winding said set yarn onto a holder while preventing the set yarn from contracting.

12. A method as claimed in claim 11, wherein the temperature of said heated roller used in said passing step is in excess of 125° C.

13. A method as claimed in claim 11, wherein the fluid jet used in said forming step is an air jet.

14. A method as claimed in claim 11, further comprising a core drawing step for drawing said core yarn when said core yarn comprises POY.

15. A method as claimed in claim 11, further comprising the step of twisting said set yarn.

16. A method of forming a yarn from a core yarn and an effect yarn, comprising the steps of:

drawing said effect yarn, comprising at least one multifilament yarn, at substantially no higher than a normal drawing ratio for material from which the effect yarn is made and heating said effect yarn sufficiently in order to soften the effect yarn, to prevent rupturing the effect yarn during drawing and to reduce the possibility of inconsistent dyeing in a subsequent process;

transporting any one of said core and effect yarns, through a wetting device;

overfeeding said effect yarn to a fluid jet the amount of overfeeding being dependent on the denier of the core yarn;

feeding said core yarn to said fluid jet wherein said core yarn has been drawn at substantially no higher than a drawing ratio for material from which the core yarn is made;

forming a highly entangled looped yarn from said core and effect yarns in said fluid jet, wherein said effect yarn has surface loops;

passing said highly entangled looped yarn around a heated roller to form a set yarn, while preventing said highly entangled loop yarn from contracting and preserving said surface loops in said effect yarn; and winding said set yarn onto a holder while preventing the set yarn from contracting.

17. A method as claimed in claim 16 wherein the temperature of said heated roller used in said passing step is in excess of 125° C.

18. A method as claimed in claim 16, wherein the fluid jet used in said forming step is an air jet.

19. A method as claimed in claim 16, further comprising a core drawing step for drawing said core yarn when said core yarn comprises POY.

20. A method as claimed in claim 16, further comprising the step of twisting said set yarn.

21. A method of forming yarn from a core yarn and an effect yarn, comprising the steps of:

drawing said effect yarn, comprising at least one multifilament yarn, at substantially no higher than a normal drawing ratio for material from which the effect yarn is made and heating said effect yarn sufficiently in order to soften the effect yarn, to prevent rupturing the effect yarn during drawing and to reduce the possibility of inconsistent dyeing in a subsequent process;

transporting any one of said core and effect yarns through a wetting device;

overfeeding said effect yarn to a fluid jet, the amount of overfeeding being dependent on the denier of the core yarn;

feeding said core yarn to said fluid jet wherein said core yarn has been drawn at substantially no higher than a normal drawing ratio for material from which the core yarn is made;

forming a highly entangled looped yarn from said core and effect yarns in said fluid jet, wherein said effect yarn has surface loops;

passing said highly entangled looped yarn around a heated roller while preventing it from contracting;

annealing and shrinking said surface loops around said core yarn for forming a set yarn; and winding said set yarn onto a holder while preventing the set yarn from contracting.

22. A method as claimed in claim 21, wherein the temperature of said heated roller used in said passing step is in excess of 125° C.

23. A method as claimed in claim 21, wherein the fluid jet used in said forming step is an air jet.

24. A method as claimed in claim 21, further comprising a core drawing step for drawing said core yarn when said core yarn comprises POY.

25. A method as claimed in claim 21, further comprising the step of twisting said set yarn.

26. A method of forming yarn from a core yarn and an effect yarn comprising the steps of:

drawing said effect yarn, comprising a plurality of multifilament yarns, at substantially no higher than a normal drawing ratio for material from which said effect yarn is made and heating said effect yarn sufficiently in order to soften the effect yarn, to prevent rupturing the effect yarn during drawing and to reduce the possibility of inconsistent dyeing in a subsequent process;

transporting any one of said core and effect yarns, through a wetting device;

inducing differential shrinkage in said plurality of multifilament yarns by differential draw temperatures provided by hot pins;

overfeeding said plurality of multifilament yarns with differential shrinkage comprising said effect yarn to a fluid jet and the amount of overfeeding being dependent on the denier of the core yarn;

feeding said core yarn to said fluid jet wherein said core yarn has been drawn at substantially no higher than a normal drawing ratio for material from which the core yarn is made;

forming a highly entangled looped yarn from said core and effect yarns in said fluid jet, wherein said effect yarn has surface loops;

passing said highly entangled looped yarn around a heated roller for causing the overfed yarn having the highest shrinkage to shrink and thus lock the loops of the other yarns thereby forming a set yarn, wherein said highly entangled looped yarn is prevented from contracting; and winding said set yarn onto a holder while preventing the set yarn from contracting.

27. A method as claimed in claim 26, wherein the temperature of said heated roller used in said passing step is in excess of 125° C.

28. A method as claimed in claim 26, wherein the fluid jet used in said forming step is an air jet.

29. A method as claimed in claim 26, further comprising a core drawing step for drawing said core yarn when said core yarn comprises POY.

30. A method as claimed in claim 26, further comprising the step of twisting said set yarn.

31. An apparatus for forming a yarn from a core yarn and an effect yarn, comprising:

drawing means including drawing rollers for drawing said effect yarn at substantially no higher than a normal drawing ratio for material from which the effect yarn is made;

feeding means for receiving said drawn effect yarn and said core yarn and feeding out said drawn effect yarn and said core yarn;

wetting means for receiving any one of said core and effect yarns from said feeding means and for wetting and outputting said received yarn;

fluid jet means for receiving said drawn effect yarn and for receiving said core yarn, wherein said feeding means overfeeds said drawn effect yarn, and for outputting a highly entangled looped yarn formed from said overfed drawn effect yarn and said core yarn;

setting means including a heated roller for receiving said highly entangled looped yarn and outputting a set yarn in which surface loops are maintained; and holding means on which said set yarn is wound.

32. An apparatus as claimed in claim 31, wherein said drawing means further comprises core drawing rollers when said core yarn comprises POY.

33. An apparatus as claimed in claim 31, wherein said drawing means further comprises hot pins associated with said effect yarn drawing rollers for providing different drawing temperatures to multifilament yarns which comprise said effect yarns.

34. An apparatus as claimed in claim 31, wherein said drawing means further comprises hot pins associated with said effect yarn drawing rollers for providing different drawing temperatures to multifilament yarns which comprise said effect yarn.

35. An apparatus as claimed in claim 31, wherein said drawing means further comprises core drawing rollers for drawing said core yarn at substantially no higher than a normal drawing ratio for material from which said core yarn is made when said core yarn comprises POY.

36. An apparatus as claimed in claim 31, further comprising a twisting means for twisting said set yarn.

* * * * *